US006390899B1

(12) United States Patent
Loubeyre

(10) Patent No.: US 6,390,899 B1
(45) Date of Patent: May 21, 2002

(54) DEVICE FOR DECONTAMINATION OF SURFACES

(75) Inventor: Patrick Loubeyre, 8, rue des Ecoles, 39200 Saint-Claude (FR)

(73) Assignee: Patrick Loubeyre, Saint-Claude (FR)

( * ) Notice: Subject to any disclaimer, the term of this patent is extended or adjusted under 35 U.S.C. 154(b) by 0 days.

(21) Appl. No.: 09/407,503

(22) Filed: Sep. 28, 1999

(30) Foreign Application Priority Data

Sep. 29, 1998 (FR) ..... 98 12171

(51) Int. Cl.[7] ..... B24C 3/00
(52) U.S. Cl. ..... 451/90; 451/102
(58) Field of Search ..... 451/90, 102, 75; 239/398

(56) References Cited

U.S. PATENT DOCUMENTS

| | | | | | |
|---|---|---|---|---|---|
| 4,218,855 | A | * | 8/1980 | Wemmer | 451/102 |
| 4,253,610 | A | * | 3/1981 | Larkin | 451/102 |
| 4,545,157 | A | * | 10/1985 | Saurwein | 451/102 |
| 4,545,317 | A | * | 10/1985 | Richter et al. | 451/102 |
| 4,587,772 | A | * | 5/1986 | Griffiths | 451/102 |
| 4,648,215 | A | | 3/1987 | Hashish | |
| 4,666,083 | A | * | 5/1987 | Yie | 451/102 |
| 4,711,056 | A | * | 12/1987 | Herrington et al. | 451/102 |
| 4,815,241 | A | * | 3/1989 | Woodson | 451/102 |
| 4,945,688 | A | * | 8/1990 | Yie | 451/102 |
| 5,018,670 | A | * | 5/1991 | Chalmers | 451/102 |
| 5,035,090 | A | * | 7/1991 | Szucs | 451/102 |
| 5,036,631 | A | * | 8/1991 | Stoltz | 451/102 |
| 5,054,249 | A | * | 10/1991 | Rankin | 451/102 |
| 5,099,619 | A | * | 3/1992 | Rose | 451/102 |
| 5,779,523 | A | * | 7/1998 | Mesher | 451/102 |
| 5,785,582 | A | * | 7/1998 | Stefanik et al. | 451/102 |
| 5,908,349 | A | * | 6/1999 | Warehime | 451/102 |
| 5,975,996 | A | * | 11/1999 | Settles | 451/102 |
| 6,042,458 | A | * | 3/2000 | Lehnig et al. | 451/102 |

FOREIGN PATENT DOCUMENTS

| | | |
|---|---|---|
| CH | 194 519 | 3/1938 |
| DE | 32 04 861 | 8/1983 |
| DE | 37 08 608 | 2/1988 |
| DE | 4002787 | 8/1991 |
| EP | 110529 | 6/1984 |
| FR | 2 753 643 | 12/1998 |
| WO | 9709152 | 3/1997 |

OTHER PUBLICATIONS

French Preliminary Search Report in SN/9812171—France.

* cited by examiner

*Primary Examiner*—M. Rachuba
(74) *Attorney, Agent, or Firm*—Bugnion S.A.; John Moetteli

(57) ABSTRACT

The device consists of an outer body (1) with a cylindrical bore (2) housing the mixing chamber (5), a sleeve (7) fitted to the outer body (1) and housing in a bore (8) a second body of revolution (9). The outer body (1) is provided with a first inlet (13) for the supply of liquid to the mixing chamber, and with a second inlet (11) with is oblique and offset from the axis of the mixing chamber (5) for of the mixture of air and fine particulate. The second inlet (11) is situated in such a way that a mixture of air and fine particulate reaches the inner wall of the chamber (5) near its upstream end.

5 Claims, 1 Drawing Sheet

Fig.1
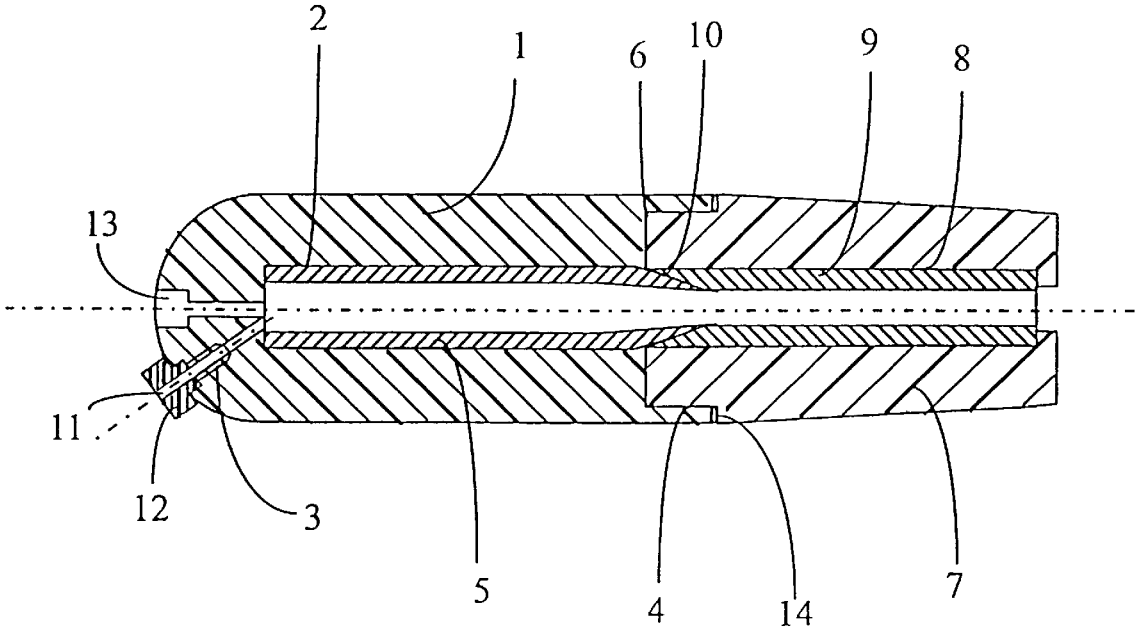
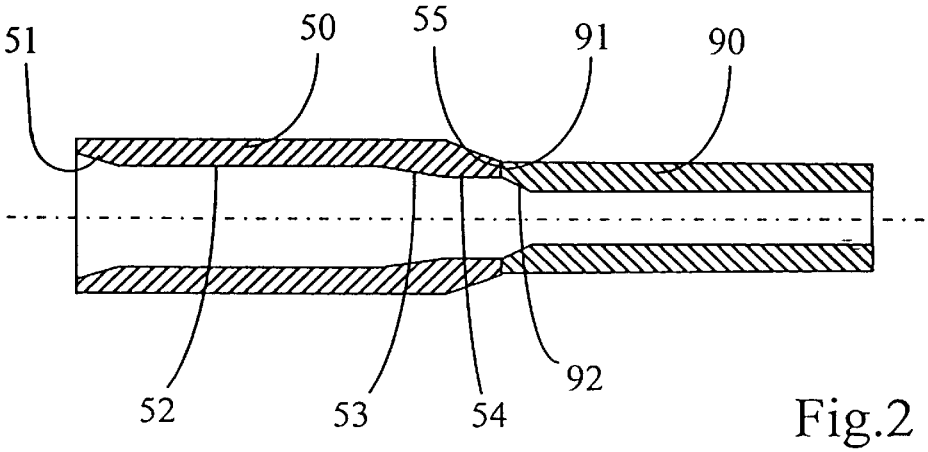
Fig.2

DEVICE FOR DECONTAMINATION OF SURFACES

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a device for the decontamination of surfaces, by means of a composite jet of compressed air, a fine sprayable particulate and a liquid, comprising a mixing chamber in the shape of a body of revolution supplied axially by said liquid and obliquely and eccentrically with respect to the axis of said chamber with the mixture of air and fine particulate, said chamber communicating with a spray nozzle.

2. Description of the Related Art Including Information Disclosed Under 37 CFR 1.97 AND 1.98

The use of equipment for cleaning surfaces, in particular the facades of buildings or monuments contaminated by atmospheric pollution or the passage of time, or by deliberate action (graffiti), has been known for several years. Such equipment basically comprises the use of a jet of compressed air comprising a fine sprayable particulate usually known as abrasive and the use of a liquid which in most cases is clear water. One of the important elements of this equipment, besides of course the various machines supplying the air, water and fine particulate, is the nozzle itself mounted on a control handle. Such a control handle is described in FR B 2,753,643, the content of which is incorporated by reference, by the same inventor. The nozzle in that equipment has a very important function because its construction and geometry are such as to give the jet a movement of rotation about an axis, thus making it possible to reproduce to a greater or lesser degree a rubbing movement over the surface that is to be decontaminated. The nozzle is a component that suffers wear, if only because of the presence of the fine particulate and the pressure to which this particulate is subjected. In theory, the materials used exhibit high resistance to abrasion by said particulate. Nevertheless, after a certain number of uses said nozzle must be replaced if the efficiency of the jet is not to be diminished. At present, when the work is no longer done satisfactorily the nozzle is replaced, instead of replacing only the part which is worn. This part is often the upstream part of the mixing chamber which is the first to receive the jet of air and the fine particulate.

U.S. Pat. No. 4,648,215, the content of which is incorporated by reference, provides a production method based essentially on the presence of a high-pressure liquid which entrains the abrasive and the air (by the Venturi effect) to form a jet, an apparatus and a nozzle for carrying out the method.

Document DE-A-40 02 787, the content of which is incorporated by reference, provides a nozzle, the entrainment of the abrasive being provided by a liquid.

SUMMARY OF THE INVENTION

The present invention is directed toward a nozzle in which the abrasive is displaced by compressed air, the liquid having more a function of comfort, namely to ensure that the dust produced in the course of decontamination does not either inconvenience the user or pollute the surrounding air. In certain situations, the water supply can be turned off without reducing the desired effect.

It is an object of the present invention to provide a novel nozzle that overcomes the abovementioned drawbacks.

The decontamination device according to the present invention consists of an outer body with a cylindrical bore housing the mixing chamber, a sleeve of approximately cylindrical shape with means for fitting it to said outer body and housing in a bore a second body of revolution forming said spray nozzle; while said outer body is provided with a first inlet for the supply of liquid in the axial direction to the mixing chamber, and with a second inlet whose axis is oblique and offset from that of the mixing chamber for the entry of the mixture of air and fine particulate; and said second inlet is situated in such a way that the mixture of air and fine particulate reaches the inner wall of the mixing chamber near its upstream end and is offset from the axis of the mixing chamber toward the left when on the northern hemisphere and toward the right when on the southern hemisphere so that the jet of air and sprayable material benefits from the Coriolis effect.

The advantages of the nozzle according to the invention are the fact that it consists of four main components, namely the outer body which takes the mixing chamber, and the sleeve which protects the nozzle itself and is also a body of revolution. These are individually interchangeable, so only the worn part or a part that has become damaged need be replaced, rather than replacing the whole of the device as in the current practice. In addition, the fact that the jet of air and fine sprayable particulate falls onto the end of the chamber means that the entire length of the chamber can be used to give it the desired movement in order to obtain maximum efficiency of the nozzle outlet, unlike what happens in devices that use the liquid as a vehicle for the particles. Also, the fact that the second inlet is offset from the axis of the mixing chamber so that the jet of air and sprayable material benefits from the acceleration due to the Coriolis effect makes it possible to obtain maximum kinetic energy at the nozzle outlet and therefore great efficiency. This displacement must of course take place either to the left or to the right, depending on which hemisphere of the earth of the device is being used.

Another advantage also is the fact that the mixing chamber can be reused if it is rotated for example through 180°, thereby doubling the life of the mixing chamber, which is a substantial economy. It would also be possible to regulate the life of the chamber if the chamber is rotated through 120°, which offers an even more substantial economy. Thus, for the component which suffers the greatest wear, it is possible either to extend its life by rotating it through 180° or 120° inside the outer body, or to replace it well before replacing the nozzle which suffers less wear and in any case symmetrical wear because in this part the jet is moving helically, but always in the tangential direction relative to the wall of the nozzle, which is not true of the jet when it first strikes the upstream part of the wall of the mixing chamber.

In an alternative embodiment, the mixing chamber is formed by a cylindrical upstream part and a narrowing conical downstream part thus allowing the jet to pass through the interior of the mixing chamber toward a cross section of decreasing diameter in order to reach the next component which is the nozzle itself.

In another alternative embodiment, the inlet for the supply of air and particulate comprises a rod made of an abrasion-resistant material which is screwed into a tapped hole in the outer body and is surrounded by a bushing, made preferably of plastic, and the pipe for the supply of air and fine particulate is attached to this bushing by a screw thread or other means.

This construction also provides an inlet which has good resistance to the abrasion caused by the fine particulate. This rod can therefore be replaced when worn without having to replace the entire inlet device and this also makes for a component whose cost is not very high, which would be the case if this inlet were made from a single piece of abrasion-resistant material.

In another alternative embodiment, the mixing chamber also ends on its outer part in a cone which becomes narrower and mates with the second body of revolution whose upstream end is a complementary surface so that it is possible by connection to form a continuous channel between the mixing chamber and the outlet nozzle.

In another alternative embodiment, the wall of the mixing chamber comprises upstream a conical part that narrows toward the center of the chamber, followed by a cylindrical part, followed by a narrowing conical part, and the downstream end of said mixing chamber has an annular surface by which it bears against a corresponding annular surface of the second body of revolution.

BRIEF DESCRIPTION OF THE DRAWINGS

The invention will be described in more detail with the aid of the drawing.

FIG. 1 is a view in axial section of the device according to the present invention.

FIG. 2 is a view in axial section of only the mixing chamber and the second body of revolution in a second alternative embodiment.

DETAILED DESCRIPTION OF THE PREFERRED EMBODIMENT(S)

The device according to the present invention shown in the Figure comprises an outer body 1 with a bore 2 containing a body of revolution 5 which forms the mixing chamber. The body 1 is provided with a tapped axial passage 13 for connection to a line supplying liquid which will preferably be water, and with a second tapped hole 3 arranged to form an angle of the order of 25° to 30° with the axis of the chamber 5, and the axis of this tapped bore 3 is also slightly offset from the axis of the chamber 5 by about 1 to 4 mm toward the left of the axis of the mixing chamber relative to the direction of movement of the jet in order to benefit from the Coriolis effect. If in the southern hemisphere, this movement must be toward the right. This results in the maximum kinetic energy by additionally using the whole of the length of the chamber 5. A threaded rod 11 is screwed into the tapped hole. The rod 11 is made of an abrasion-resistant material. Fixed around this rod 11 is a bushing 12 made of a plastic material and provided on its upper end with a device for connection to a supply line. The device may be a bayonet or screw thread or any other ordinary connecting device. The line formed in this way allows the chamber 5 to be supplied with air and fine particulate. The chamber 5 is located inside the body 1 so that the mixture comprising the air and fine particulate touches the wall upstream of the chamber before continuing to advance down the chamber with a helical movement due primarily to the eccentric and oblique position of the inlet 3 and of course the force of the liquid.

A sleeve 7 with a bore 8 is fixed to the end of the body 1 by any conventional means 4, the simplest being a screw connection, with a seal 14 to make the joint leaktight. Inside the bore 8 is a body of revolution 9 presenting a passage having a diameter of the order of 10 mm. At the upstream end of this body 9 is a conical surface 10 which mates with the conical end 6 of the chamber 5. The resulting connection thus makes it possible to form a passage between the mixing chamber 5 and the body 8 which is continuous, ensuring that the jet contains no protuberances which could affect the quality and efficiency of the jet.

As mentioned earlier, the advantage of this device is that it is composed of several separate components that can be replaced individually either because of wear, or to modify the dimensions, for example of the body 9 if the fine particulate is to be used with a different size of nozzle.

It should also be noted that when the jet with the air and the fine particulate falls at the end of the chamber 5 it causes wear which is localized to the site of the impact and which after a certain number of use s can reduce the quality of the jet.

When this happens, it is necessary to replace the chamber 5, which can be done without replacing the whole of the device by, as mentioned earlier, rotating this chamber through 180° or through a third of a revolution in order to use the other part of the chamber which is not affected by the jet, which in reality does not disturb the dynamic qualities of the nozzle because this part of the surface of the chamber does not come into contact with the mixture of air and fine particulate except in the region of the impact, after which the jet advances helically.

As an example it may be mentioned that the mixing chamber 5 may be made of carbide, the body 9 of sintered aluminum, the outer body 1 of aluminum or elastomer, Nylon, vinyl etc. The sleeve 7 could also be made of elastomer, vinyl, Nylon etc.

In an alternative embodiment shown in FIG. 2, the chamber 50 has a conical part 51 downstream to facilitate the access of the jet of air and fine particulate, followed by a cylindrical part 52 and terminating in a new conical part 54. The downstream end of the chamber has an annular surface 55 by which the chamber 50 bears against a corresponding surface 91 of the second body of revolution 90. Because the inside diameter of this body 90 is smaller than the smallest diameter of the chamber 50, a conical part 92 upstream of the body 90 enables a continuous passage to be formed without sudden changes to the cross section, which would lead to turbulence and wear of nearby components. This configuration of components 50 and 90 avoids sharp extremities which could break under the impact of the arrival of the jet.

Although illustrative embodiments of the invention have been shown and described, a wide range of modification, change and substitution is contemplated in the foregoing disclosure and in some instances, some features of the present invention may be employed without a corresponding use of the other features. Accordingly it is appropriate that the appended claims be construed broadly and in a manner consistent with the scope of the invention.

SEQUENCE LISTING

Not Applicable

What is claimed is:

1. A device for the decontamination of surfaces, by means of a composite jet of compressed air flowing from an upstream end (1') defined adjacent to inlets (11, 13), to a downstream end (7'), defined adjacent to an outlet, and a fine sprayable particulate and a liquid, the device comprising:

(a) a generally cylindrical hollow mixing chamber (5, 50);

(b) a generally cylindrical hollow spray nozzle (7, 9; 90);

(c) an outer body (1) having a bore (2) housing the mixing chamber (5, 50); and (d) a sleeve (7) of substantially cylindrical shape having a bore (8) housing the spray nozzle (7, 9; 90), the outer body (1) and the sleeve (7) being connected by attachment means (4, 14) such that the mixing chamber and spray nozzle are held adjacent one another, wherein the mixing chamber (5, 50) is supplied axially (13) by said liquid and is obliquely offset with respect to the axis of said chamber (5, 50) with the mixture of air and fine particulate, said chamber being in fluid communication with the spray nozzle (7, 9; 90); wherein said outer body (1) is provided with a first inlet (13) for the supply of liquid in the axial direction to the mixing chamber (5, 50), and with a second inlet (3, 11) whose axis is oblique and offset from that of the mixing chamber for the entry of the mixture of air and fine particulate; and wherein said second inlet (3, 11) is situated in such a way that the mixture of air and fine particulate reaches the inner wall of the mixing chamber (5, 50) near the upstream end as defined with respect to fluid flow and is offset from the axis of the mixing chamber toward one side when on the northern hemisphere and toward another side when on the southern hemisphere, the side being determined so that the jet of air and sprayable material benefits from the Coriolis effect.

2. A device as claimed in claim 1, in which the mixing chamber (5, 50) comprises a cylindrical part (22; 52) and ends downstream in a narrowing conical part (6; 53, 54).

3. A device as claimed in claim 1, in which the inlet for the supply of the mixture of air and fine particulate comprises a hollow rod (11) made of an abrasion-resistant material screwed into a tapped hole (3) in the outer body (1), and wherein a plastic bushing (12) surrounds this rod (11) and is provided with means for connection thereto of a supply line carrying said mixture.

4. A device as claimed in claim 1, in which the outer part of the downstream end of the mixing chamber (5) is conical (6), while the upstream end of the nozzle (9) has a complementary opening (10) enabling an intimate connection between the downstream end of the mixing chamber (5) and the upstream end of the nozzle (9).

5. A device as claimed in claim 1, in which the wall of the mixing chamber (50) comprises upstream a conical part (51) that narrows toward the center of the chamber, followed by a cylindrical part (52), followed by a second narrowing conical part (53, 54), and the downstream end of said mixing chamber has an annular surface (55) by which it bears against a corresponding annular surface (91) of the spray nozzle (7, 9; 90).

* * * * *